US007387111B2

(12) United States Patent
Yu et al.

(10) Patent No.: US 7,387,111 B2
(45) Date of Patent: Jun. 17, 2008

(54) IN-TANK FUEL SUPPLY UNIT WITH ATTACHABLE JET PUMP ASSEMBLY AND FILTER

(75) Inventors: DeQuan Yu, Ann Arbor, MI (US); David Zultowski, Canton, MI (US); Vipin F. Patel, Ann Arbor, MI (US); Jason Nicholas Schultz, Belleville, MI (US); Matthew Edward Wiethoff, Dexter, MI (US)

(73) Assignee: Ford Motor Company, Dearborn, MI (US)

( * ) Notice: Subject to any disclaimer, the term of this patent is extended or adjusted under 35 U.S.C. 154(b) by 776 days.

(21) Appl. No.: 10/875,365

(22) Filed: Jun. 24, 2004

(65) Prior Publication Data

US 2005/0286103 A1 Dec. 29, 2005

(51) Int. Cl.
*F02M 37/04* (2006.01)

(52) U.S. Cl. ..... 123/509; 123/514; 137/565.22

(58) Field of Classification Search ..... 123/509, 123/514, 516, 510; 417/80, 87, 151; 137/565.22, 137/566.22

See application file for complete search history.

(56) References Cited

U.S. PATENT DOCUMENTS

| | | | | |
|---|---|---|---|---|
| 1,698,619 | A | 1/1929 | Blow | |
| 4,911,134 | A | 3/1990 | Olsson | |
| 5,070,849 | A * | 12/1991 | Rich et al. | 123/509 |
| 5,341,842 | A | 8/1994 | Chih et al. | |
| 5,396,872 | A | 3/1995 | Ruger et al. | |
| 5,636,616 | A | 6/1997 | Okane et al. | |
| 5,699,773 | A * | 12/1997 | Kleppner et al. | 123/510 |
| 5,715,798 | A | 2/1998 | Bacon et al. | |
| 6,123,511 | A | 9/2000 | Sertier | |
| 6,216,671 | B1 | 4/2001 | Sawert et al. | |
| 6,260,543 | B1 | 7/2001 | Chih | |
| 6,283,142 | B1 | 9/2001 | Wheeler et al. | |
| 6,293,256 | B1 | 9/2001 | Kleppner et al. | |
| 6,341,623 | B1 | 1/2002 | Channing | |
| 6,371,153 | B1 | 4/2002 | Fischerkeller et al. | |
| 6,453,884 | B2 | 9/2002 | Ushigome | |
| 6,532,941 | B2 | 3/2003 | Begley et al. | |
| 6,607,005 | B2 | 8/2003 | Viebahn et al. | |
| 6,619,272 | B2 | 9/2003 | Jones et al. | |
| 6,679,226 | B2 * | 1/2004 | Burke et al. | 123/509 |
| 6,832,627 | B2 * | 12/2004 | Braun et al. | 137/565.22 |
| 6,843,235 | B2 * | 1/2005 | Mashimo et al. | 123/509 |
| 6,923,208 | B2 * | 8/2005 | Okabe et al. | 137/565.22 |
| 6,988,941 | B2 | 1/2006 | Saunier et al. | |
| 2003/0213477 | A1 * | 11/2003 | Ramamurthy et al. | 123/509 |
| 2004/0011336 | A1 * | 1/2004 | Finch | 123/509 |

* cited by examiner

*Primary Examiner*—Carl S Miller
(74) *Attorney, Agent, or Firm*—Gregory Brown; MacMillan Sobanski & Todd, LLC

(57) ABSTRACT

An in-tank fuel supply unit is provided for supplying fuel from a fuel tank to an engine. The fuel supply unit generally comprises a fuel delivery module and a jet pump assembly selectively attachable to the fuel delivery module. The fuel delivery module has a housing defining a reservoir and includes a fuel pump for pressurizing fuel in the reservoir. The jet pump assembly has a suction tube defining a suction chamber and a nozzle situated inside the suction chamber. The nozzle receives pressurized fuel from the fuel pump and sprays the fuel from a nozzle tip at high velocity to draw additional fuel into the suction chamber through an inlet formed in the suction tube.

17 Claims, 9 Drawing Sheets

IN-TANK FUEL SUPPLY UNIT WITH ATTACHABLE JET PUMP ASSEMBLY AND FILTER

FIELD OF THE INVENTION

The present invention relates generally to in-tank fuel supply units, and more particularly relates to the jet pump used to supply fuel to the supply unit.

BACKGROUND OF THE INVENTION

Automobiles generally include a fuel tank having a fuel supply unit operatively connected thereto for providing fuel to the injectors of the engine from the fuel tank. One general type of fuel supply units are those which are designed for placement within the fuel tank to be submersed within the fuel contained therein. Such in-tank units generally include a fuel delivery module having a reservoir, as well as a fuel pump for supplying fuel to the injectors from the reservoir. A jet pump is employed to supply fuel to the reservoir during vehicle operation.

Typically, the jet pump is integrally formed with the fuel delivery module. Thus, when access to the jet pump is desired, the entire fuel delivery module must be removed from the fuel tank. Additionally, first stage filters are generally not available with such jet pumps for filtering the fuel prior to passing through the jet pump. In order to employ a filter, a horizontal jet pump is typically formed with the fuel delivery module. Unfortunately, a horizontal jet pump results in a sacrifice of efficiency because the entrained fuel must be redirected by 90° to spray the fuel upwardly into the reservoir.

Accordingly, there exists a need to provide an in-tank fuel supply unit having a jet pump which is accessible, and also which has high efficiency and permits the use of a first stage filter.

BRIEF SUMMARY OF THE INVENTION

The present invention provides an in-tank fuel supply unit for supplying fuel from a fuel tank to an engine. The fuel supply unit generally comprises a fuel delivery module and a jet pump assembly selectively attachable to the fuel delivery module. The fuel delivery module has a housing defining a reservoir and includes a fuel pump for pressurizing fuel from the reservoir. The jet pump assembly has a suction tube defining a suction chamber and a nozzle situated inside the suction chamber. The nozzle receives pressurized fuel from the fuel pump and sprays the fuel from a nozzle tip at high velocity to draw additional fuel into the suction chamber through an inlet formed in the suction tube.

According to more detailed aspects, the selectively attachable jet pump assembly is vertically oriented and provides an extremely low inlet into the jet pump assembly. An inlet tube fluidically connected to the nozzle extends through the suction tube and into the suction chamber. The inlet tube and inlet formed in the suction tube are positioned vertically below the nozzle tip, preferably by about the same distance. Most preferably, the inlet formed in the suction tube is positioned at least 10 mm below the nozzle tip. The upper end of the suction tube presses against the housing of the fuel delivery module to create a seal, which preferably is positioned vertically above the inlet formed in the suction tube. The fuel delivery module may include an exterior recess sized to receive the jet pump assembly. A filter may be employed in conjunction with the jet pump assembly. In a non-filter version, the inlet into the suction chamber is formed in a lower end of the suction tube, preferably by removing at least a portion of the bottom wall of the suction tube.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
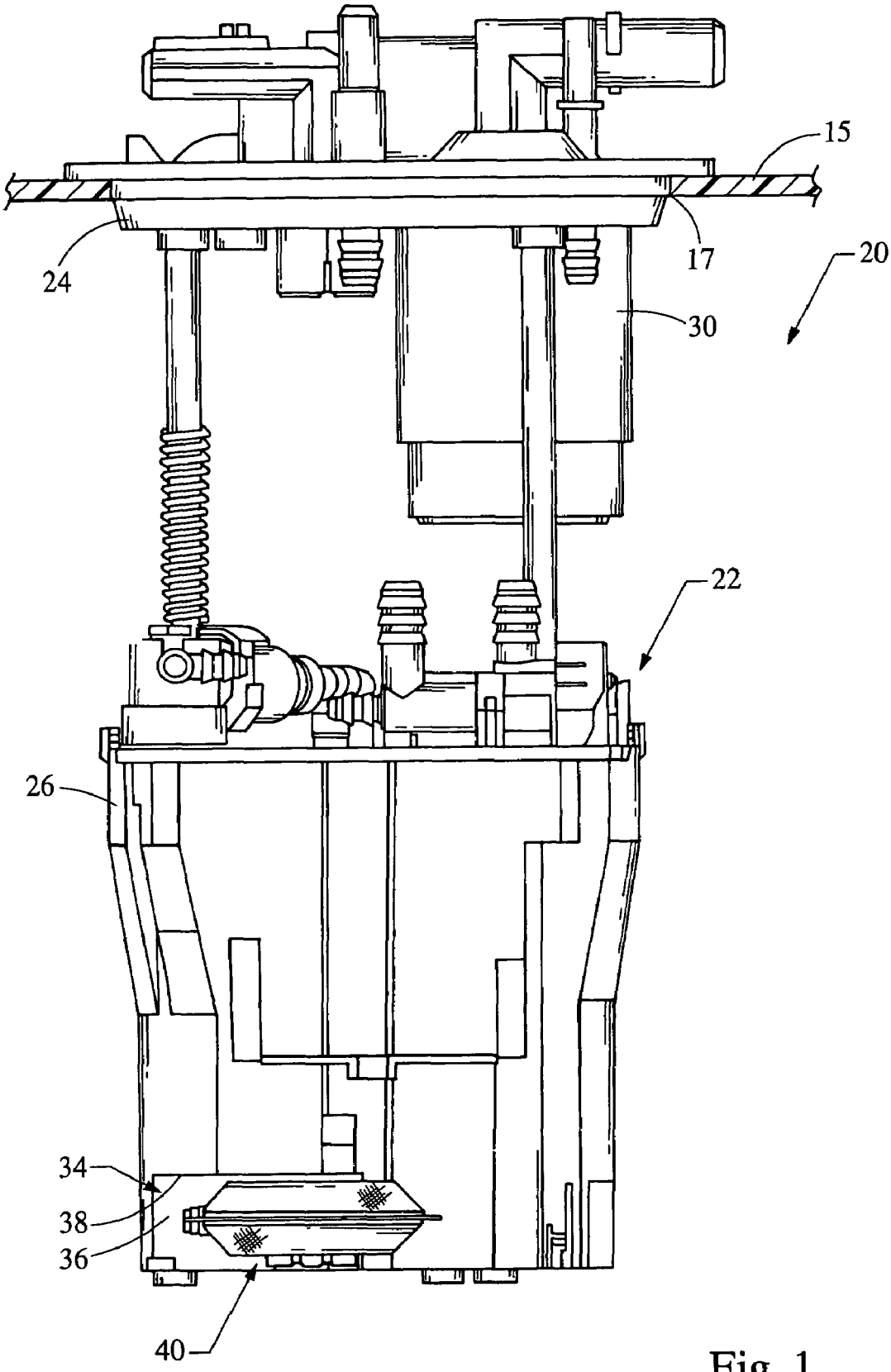
FIG. 1 is front view of in-tank fuel supply unit having a fuel delivery module and a jet pump assembly constructed in accordance with the teachings of the present invention.

Turning now to the figures, FIG. 1 depicts a front view of an in-tank fuel supply unit 20 constructed in accordance with the teachings of the present invention. The in-tank fuel supply unit 20 generally includes a fuel delivery module 22 and a jet pump assembly 40. The fuel delivery module 22 includes a flange 24 which is fitted to a wall of the fuel tank 15, and more particularly within an opening 17 defined in the fuel tank 15. The fuel delivery module 22 also includes a housing 26 defining a reservoir 28 (FIG. 8) therein. The jet pump assembly 40 is designed to draw fuel from the bottom of the fuel tank 15 into the reservoir 28. Fuel in the reservoir 28 is then supplied to the fuel injectors of an engine (not shown) by way of a pump 30 forming a portion of the fuel delivery module 22. The housing 26 defines a recess 34 about its outer periphery, the recess being defined by a horizontal surface 36 and a vertical surface 38. The recess 34 receives the jet pump assembly 40 which is designed for selective attachment to the fuel delivery module 22, as will be described in further detail herein.

Figure 2:
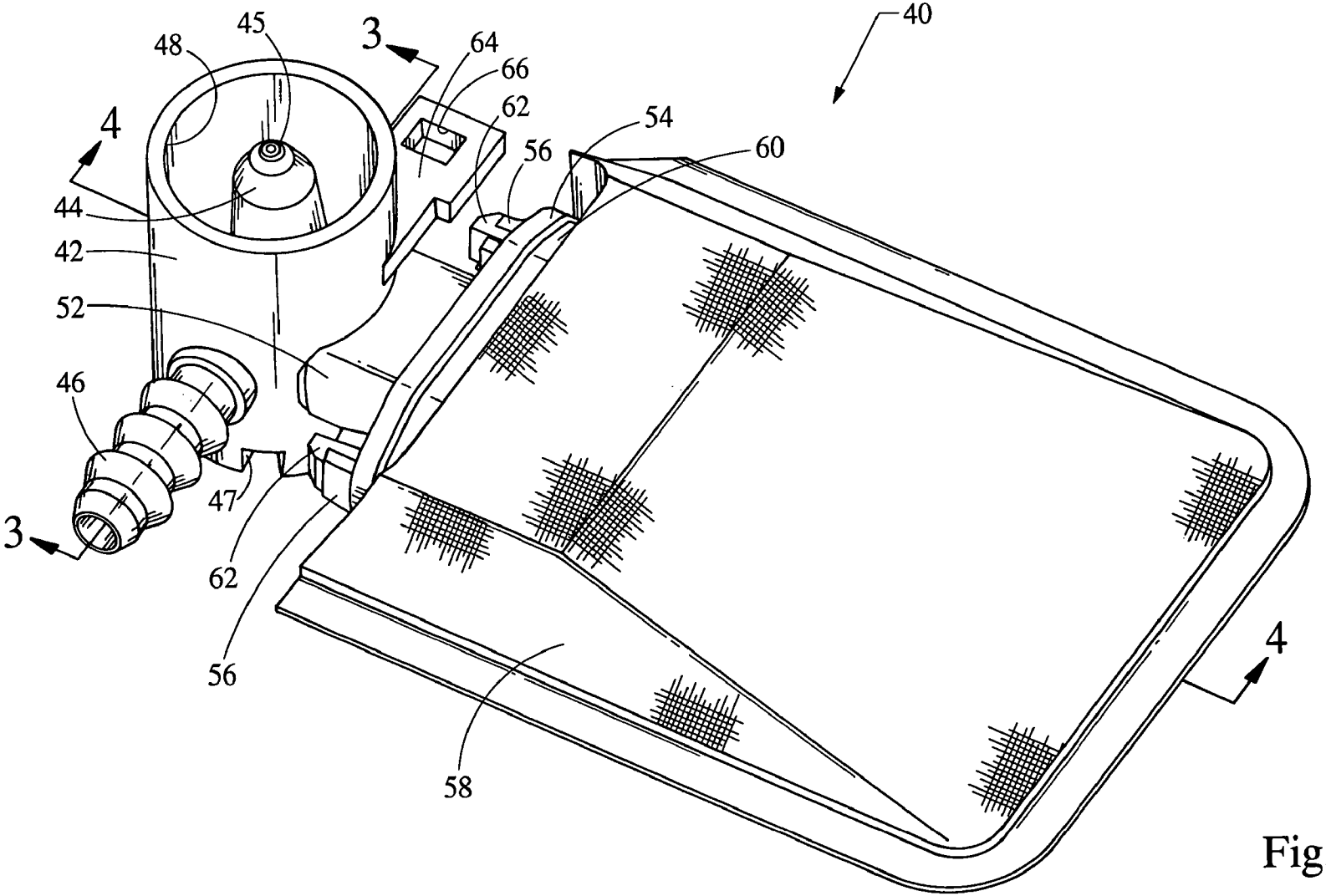
FIG. 2 is a perspective view of a jet pump assembly depicted in FIG. 1.

An enlarged perspective view of the jet pump assembly 40 is depicted in FIG. 2. The jet pump 40 generally includes a suction tube 42 which is tubular, and preferably cylindrical in nature. A nozzle 44 is situated within the suction tube 42 and is fluidically connected to an inlet tube 46. The inlet tube 46 projects laterally from the nozzle 44 and extends through the suction tube 42 with barb fittings for connection to the appropriate tubing (not shown). In operation, fuel supplied through the inlet tube 46 flows through the nozzle 44 and out the nozzle tip 45 at a high velocity to generate a vacuum and draw additional fuel into a suction chamber 48 defined between the suction tube 42 and the nozzle 45. As best seen in the cross-sectional view of FIG. 4, an inlet 50 is formed in a filter ferrule 52 which projects laterally from the suction tube 42. This inlet 50 provides the passageway through which fuel is drawn into the jet pump 40 from the fuel tank 15.

Turning to FIG. 2, the filter ferrule 52 projects laterally from the suction tube 42 and is spaced about 90° from the inlet tube 46. The filter ferrule 52 includes a flange 54 which defines female snap features 56. The flange 54 and snap features 56 are structured to receive a filter 58 which attaches to the ferrule 52 by way of its flange 60 and male snap features 62. Accordingly, it will be seen that the filter 58 is selectively attachable to the filter ferrule 52.

Finally, the jet pump assembly 40 further includes a flange 64 projecting laterally from the suction tube 42, the flange 64 including a connection aperture 66 which is structured to cooperate with corresponding connection features found on the fuel delivery module 22, as will be described in further detail herein.

Figure 3:
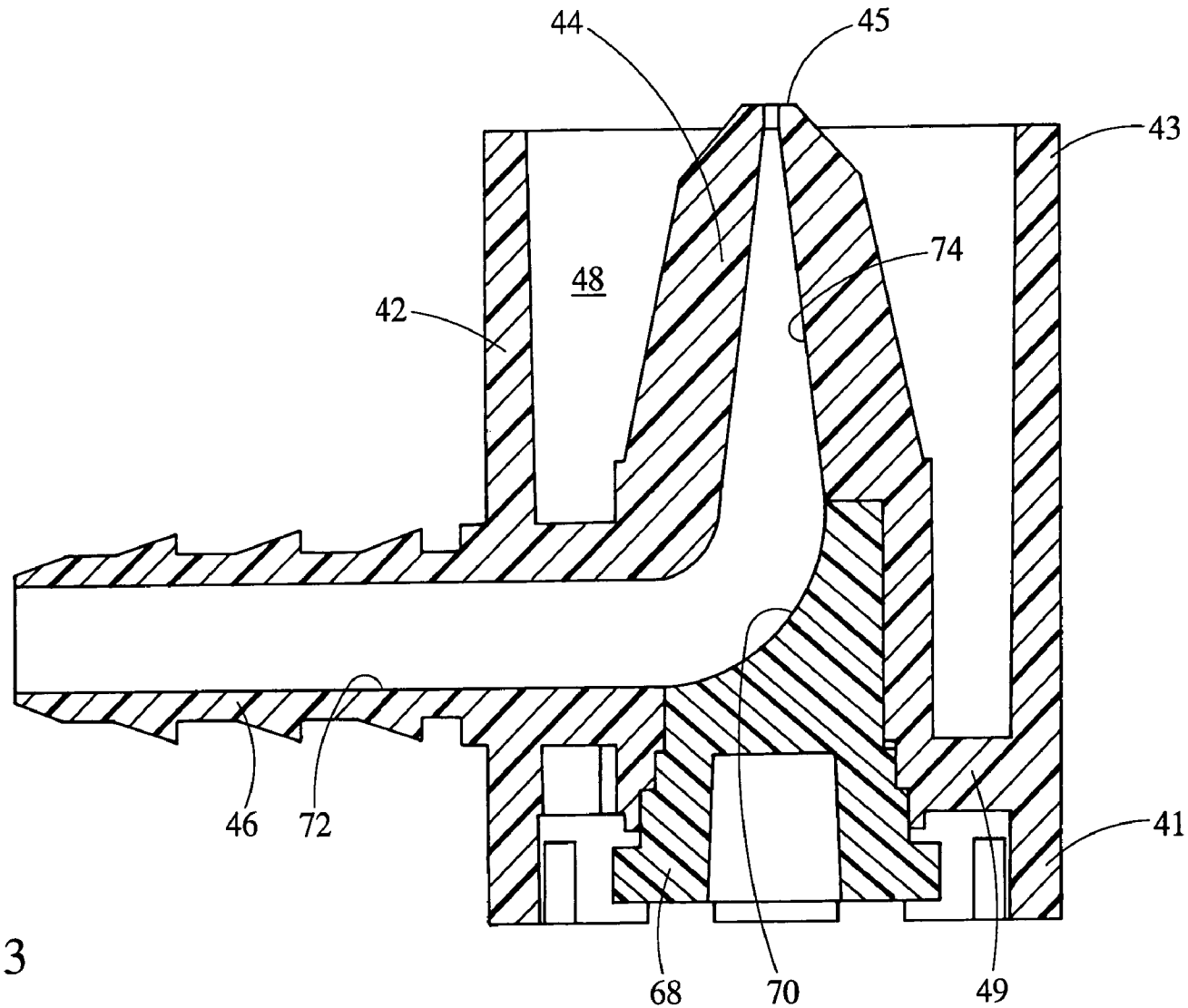
FIG. 3 is a cross-sectional view of the jet pump assembly taken about line 3-3 in FIG. 1.

Turning to FIG. 3, a cross-sectional view of the jet pump assembly 40, taken about 3-3 in FIG. 2, has been depicted. As previously mentioned, the suction tube 44 defines a suction chamber 48 therein, which also contains the nozzle 44 having a nozzle tip 45. It can been seen that the nozzle tip 45 is positioned slightly vertically above the upper end 43 of the suction tube 42. As shown in FIG. 2, the lower end 41 of the suction tube includes a plurality of notches 47, as described in more detail later herein. Notably, the inlet tube 46 defines a passageways 72 (FIG. 3) which is in fluid communication with a passageway 74 defined with the nozzle 44. In order to close off the fluidic connection between the passageway 72, 74, an end cap 68 is welded to a bottom wall 49 of the suction tube 42, and includes a curved surface 70 connecting the fluid pathway between the passages 72, 74. The end cap 68 is preferably welded to the suction tube 42, inlet 46 and nozzle 44, preferably by ultrasonic or spin welding or similar techniques. It has been discovered that the use of an end cap 68 facilitates the construction of the jet pump assembly 40, and in particular the suction tube 42, 44 and inlet tube 46, which are integrally formed by injection molding. However, it will be recognized by those skilled in the art that the end cap 68 may be dispensed with, and the inlet tube 46 and nozzle 44 may be integrally formed to define a single continuous passageway 72, 74.

Figure 4:
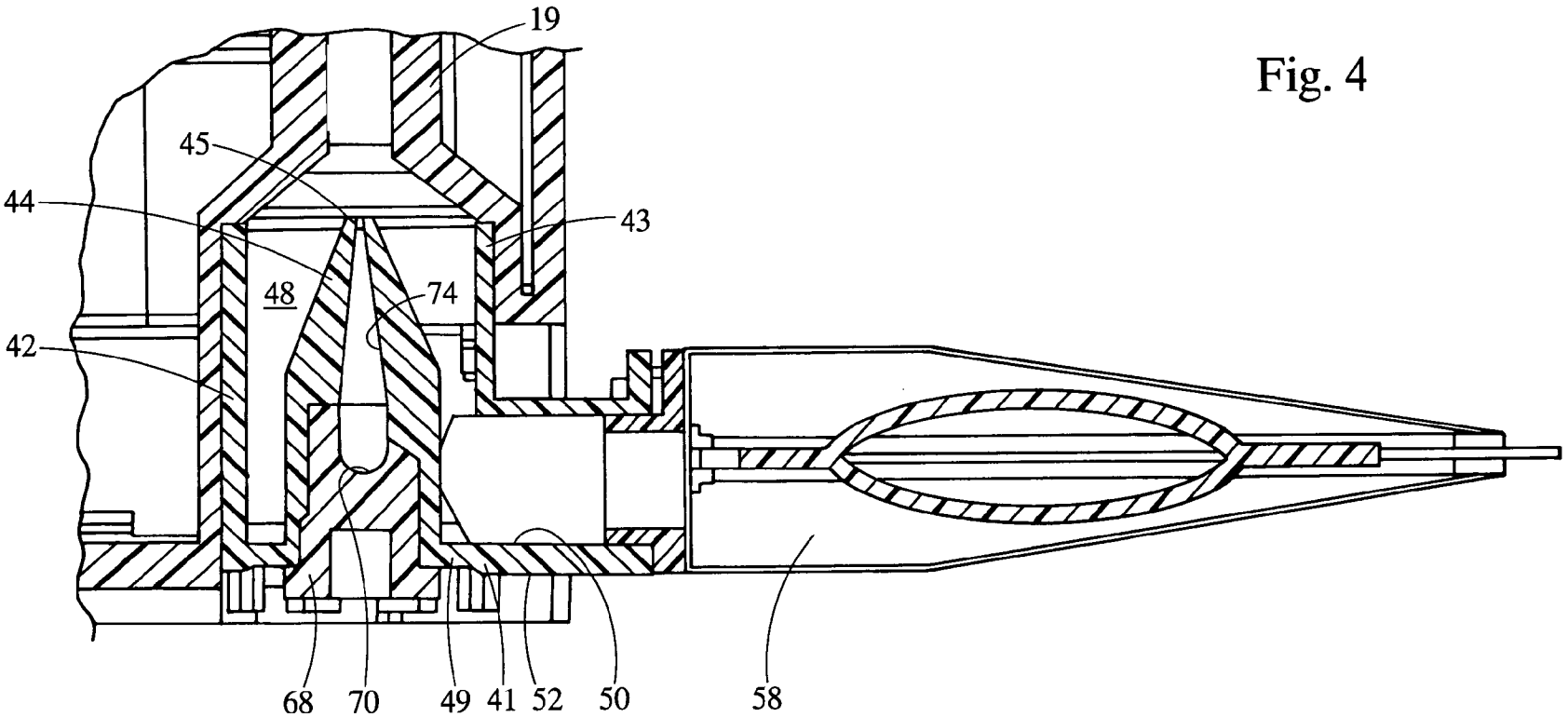
FIG. 4 is a cross-sectional view of the jet pump assembly taken about line 4-4 in FIG. 1.

Another cross-sectional view is depicted in FIG. 4, and has been taken about the line 4-4 in FIG. 2. It can be seen that the suction tube 42 has an inlet 50 which connects to the mix chamber 48. The inlet 50 also extends through the filter ferrule 52 such that fluid drawn into the jet pump 40 first passes through the filter 58. The filter 58 may be any filter as is known in the art, and typically comprises a flexible filter media or sock. The nozzle 44 is aligned with a mix tube 19 integrally formed with the housing 26 of the fuel delivery module 32. It can also be seen in FIG. 4 that the inlet 50 is located adjacent the bottom wall 49 of the suction tube 42. That is, the inlet 50 is positioned below the nozzle tip 45 about the same distance as the inlet tube 46. The inlet 50 is preferably positioned at least 10 mm below the nozzle tip 45, and most preferably at least 15 mm below the nozzle tip 45. By providing a selectively attachable jet pump 40, the nozzle 44, its tip 45, and the inlet 50 may be located extremely close to the bottom of the fuel tank 15 to improve low-fuel level handling capabilities, while at the same time providing an efficient vertical pump design that has little to no welding during assembly and permits use of a filter.

Figure 5:
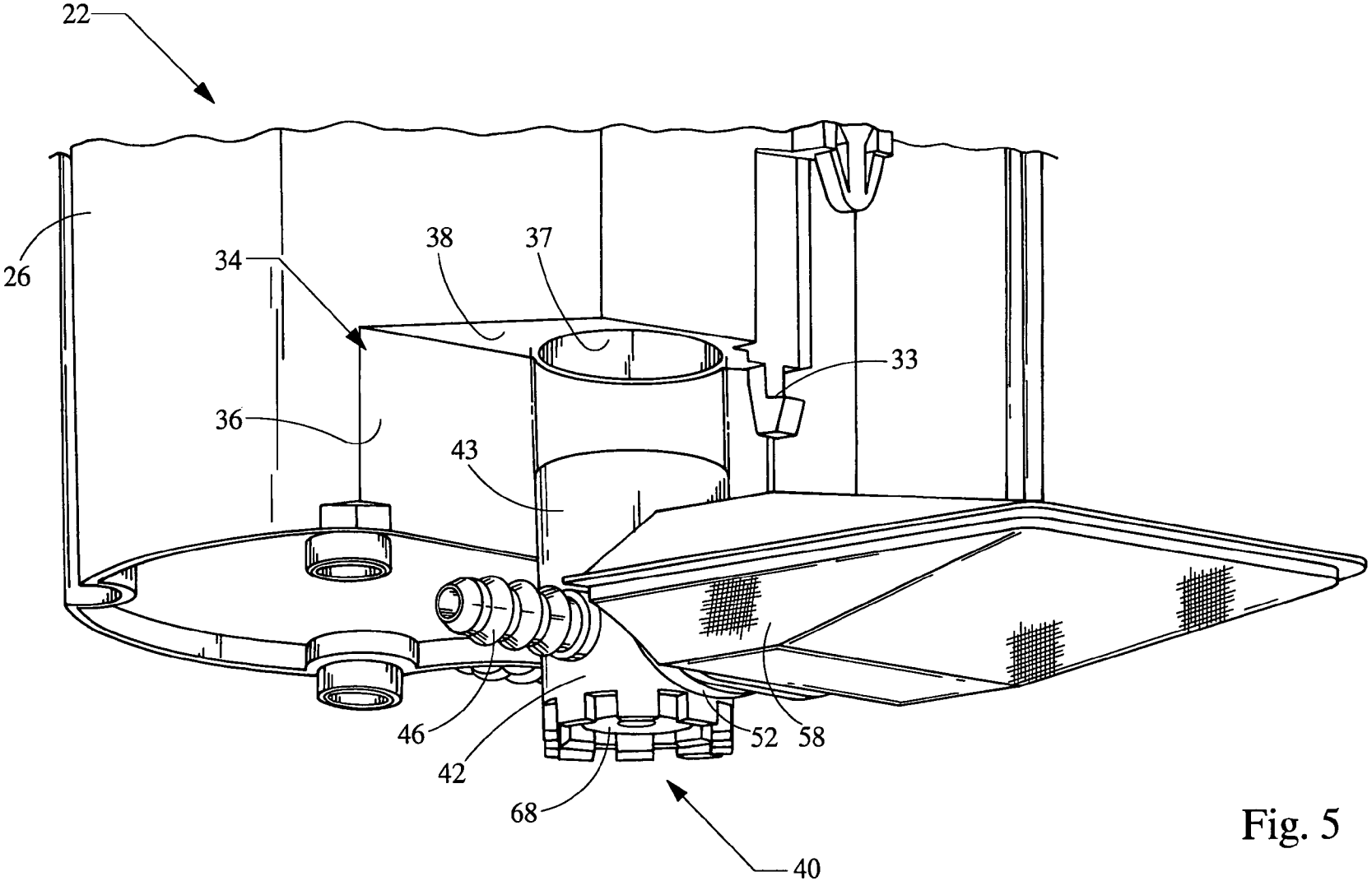
FIG. 5 is a perspective view of the jet pump assembly depicted in FIG. 1 in position for attachment to a fuel delivery module.

Connection of the jet pump assembly 40 to fuel delivery module 22 will now be described with reference to FIGS. 5 and 6. As previously mentioned, the housing 26 of the fuel delivery module 22 defines a recess 34 defined by horizontal and vertical surfaces 36, 38, respectively. It can be seen in FIG. 5 that the housing 26 further includes a male connection feature 33 which corresponds with the flange 64 and connection aperture 66 formed on the jet pump assembly 40 and suction tube 42. The housing 26, and more particularly the horizontal surface 38, defines a filter pocket 37 sized to receive the suction tube 42, and more specifically the upper end 43 of the suction tube therein.

Figure 6:
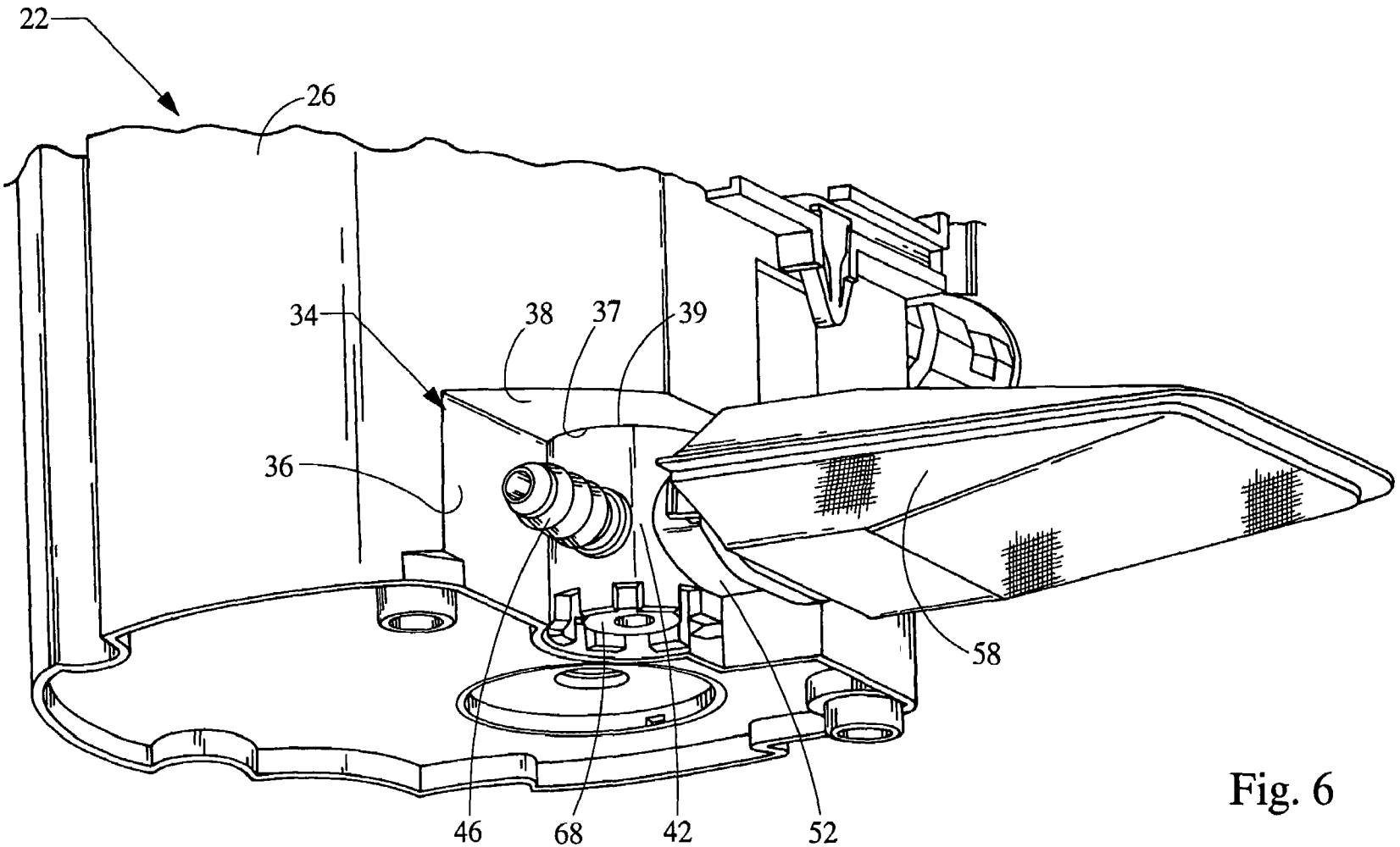
FIG. 6 is a perspective view similar to FIG. 5 but showing the jet pump assembly attached to the fuel delivery module.

As shown in FIG. 6, the jet pump assembly 40 is moved upwardly to place the upper end 43 of suction tube 42 within the pocket 37 formed in the housing 26. For proper function of the jet pump 40, the suction tube 42 and housing 26 form a seal 39 therebetween to prevent unwanted entry of air during low fuel conditions. Thus, the suction tube 42 frictionally engages the wall of the pocket 37 in the housing 26 to define a seal therebetween. However, it will be recognized by those skilled in the art that numerous other structures, including additional materials, may be employed to form a seal between the suction tube 42 and housing 26.

Figure 7:
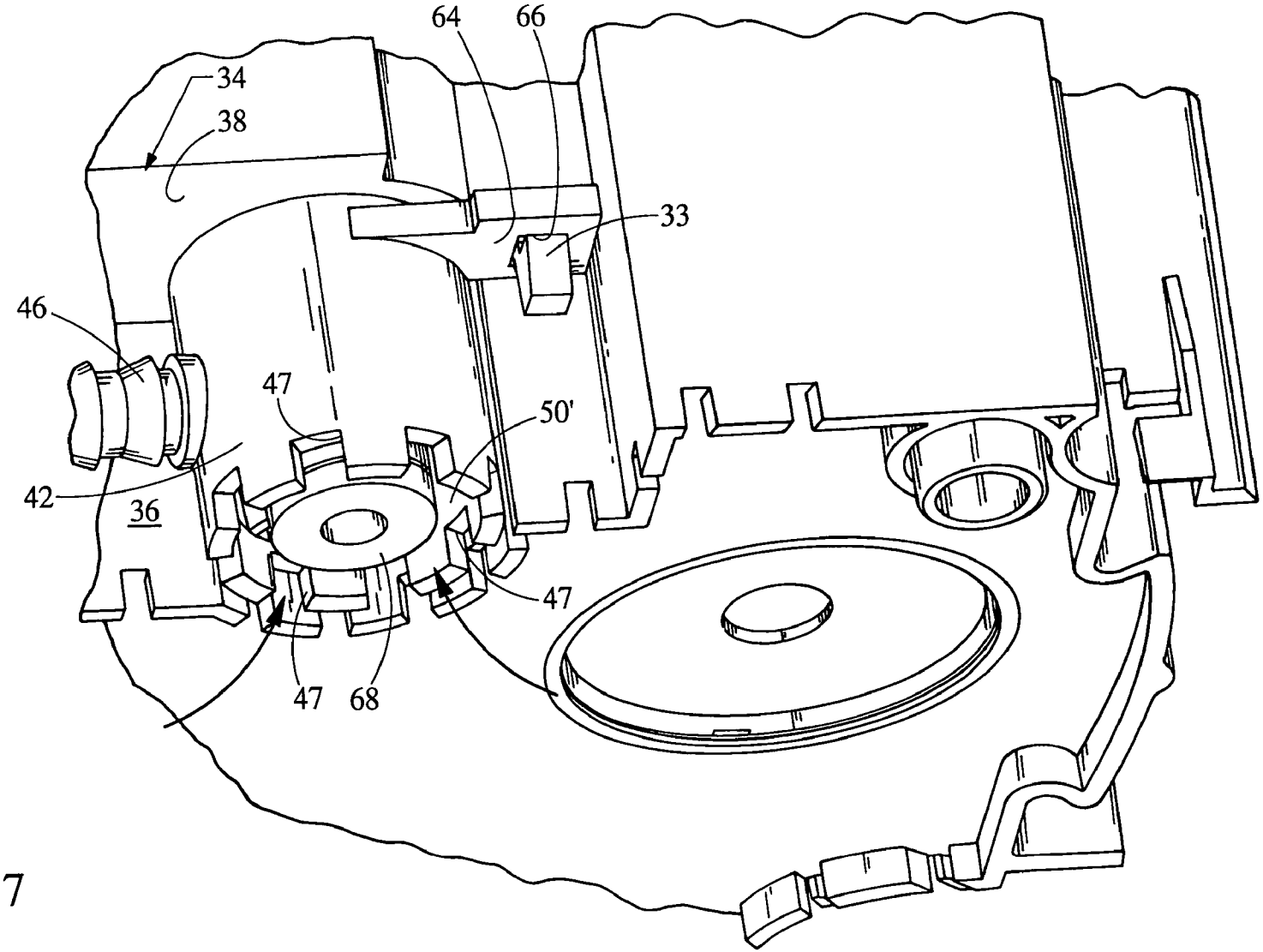
FIG. 7 is a perspective view of another embodiment of the jet pump assembly, not having a first stage filter, attached to the fuel delivery module.

An alternate embodiment of the jet pump assembly 40 is shown in FIG. 7. In this embodiment, common parts have been given common reference numerals to aid in the understanding of the embodiment, which is generally a non-filter version of the vertical jet pump assembly 40 previously disclosed. It can be seen that the filter ferrule 52 and corresponding structure has been removed from the outer periphery of the suction tube 42. It can also be seen that the inlet to the suction chamber 48 is now provided proximate the bottom end 41 of the suction tube, and has been designated by reference numeral 50'. It will be seen with reference to FIG. 7 in conjunction with FIG. 3 that the bottom wall 49 of the suction tube 42 has been at least partially removed to define the inlet 50'. The notches 47 formed at the lower end 41 of the suction tube 42 assist in allowing fuel to enter the inlet 50' directly from the bottom of the fuel tank 15. In this embodiment, the jet pump assembly 40' provides an extremely low inlet 50' which allows the jet pump assembly 40' to draw fuel in from the very bottom of the fuel tank 15.

Figure 8:
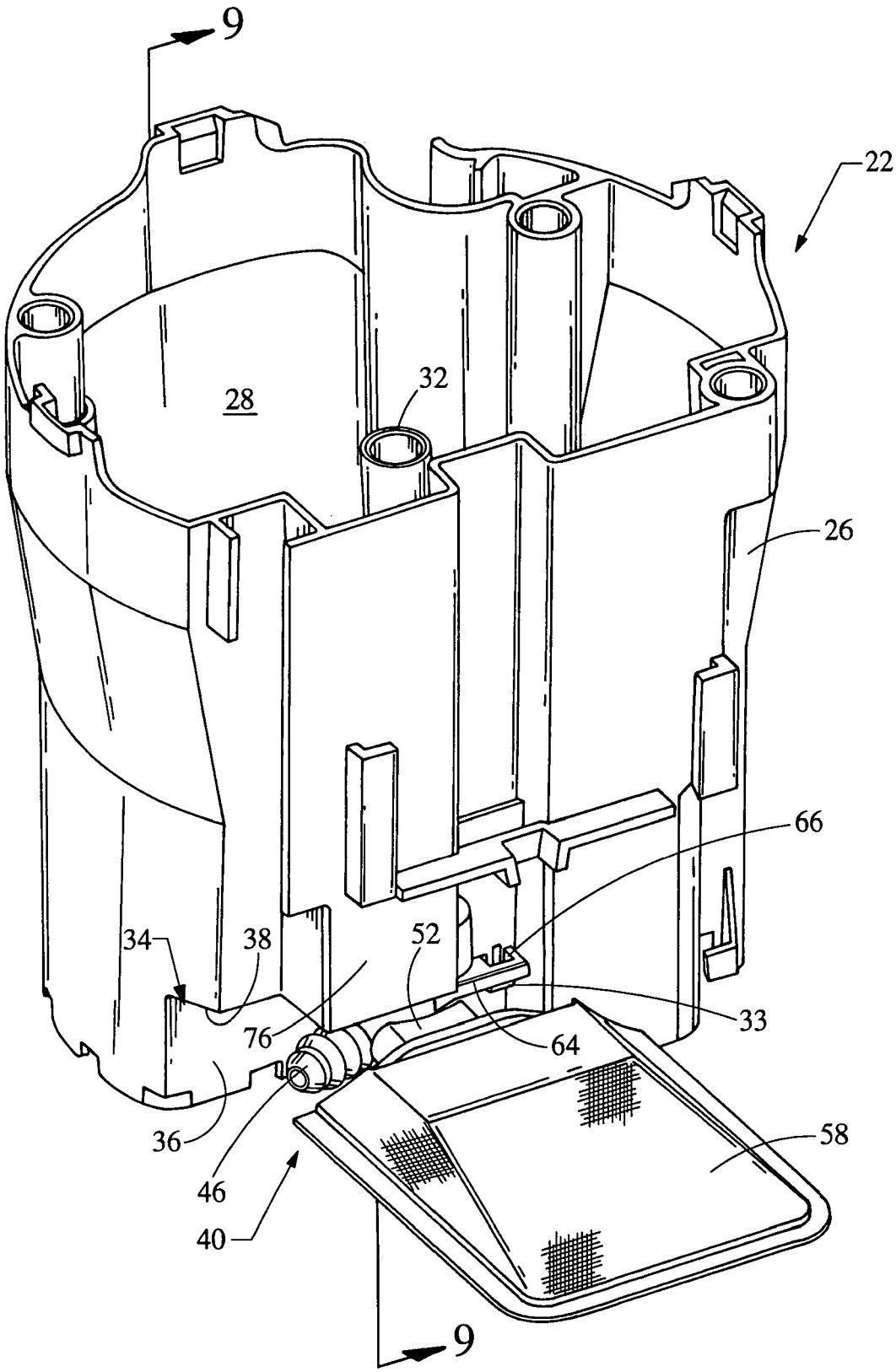
FIG. 8 is a perspective view of yet another embodiment of a jet pump assembly in a fuel delivery module.
Figure 9:
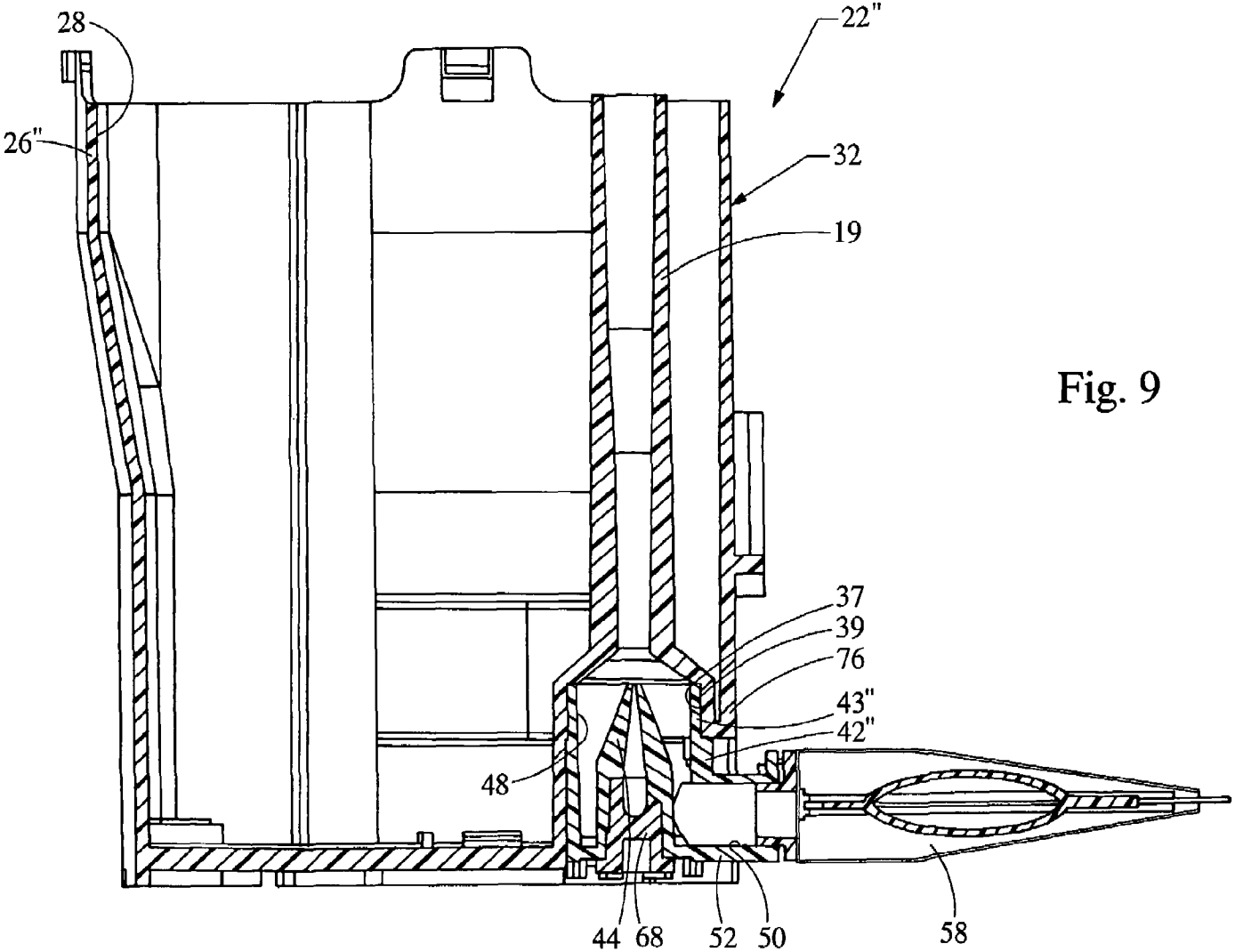
FIG. 9 is cross-sectional view of the jet pump assembly and fuel delivery module taken about line 9-9 in FIG. 8.

Turning to FIGS. 8 and 9, yet another embodiment of the in-tank fuel supply unit 20' has been shown. Again, common reference numerals have been used with common components from the prior embodiments to aid in the understanding of the embodiment. It will be seen that the housing 26" of the fuel delivery module 22" includes a shielding wall 76 located proximate the recess 34 formed in the housing 26". It can also be seen in FIG. 8 that the inlet tube 46 has been rotated closest to the filter ferrule 52, and is positioned about 45° therefrom.

With reference to FIG. 9, it can be seen that the jet pump assembly 40" has also been slightly modified. In this embodiment, the suction tube 42" includes an upper end portion 43" which is smaller in diameter than the remainder of the suction tube 42", thereby forming a shoulder which abuts against the housing 26" to ensure proper positioning of the jet pump 40" and a reliable seal 39. At the same time, the tubular pocket 76 is still sized to receive the upper end 43" of the suction tube 42" and to form a seal 39 therewith, as was discussed in prior embodiments. Accordingly, it can be seen that the jet pump assembly 40" is well protected by the housing 26" and its shield wall 76 of the fuel delivery module 22", and also provides a structure which insures a good seal 39 between the jet pump assembly 40" and the fuel delivery module 22".

Accordingly, it will be seen by those skilled in the art that the in-tank fuel supply unit of the present invention offers a high efficiency of a vertical jet pump while at the same time providing easy attachment to the fuel delivery module. Furthermore, by providing a separate jet pump assembly 40, the pump may be vertically oriented provides 360° of entrained fuel as well as a low fuel inlet enabling the jet pump to prime in low fuel conditions, with or without a filter.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. An in-tank fuel supply unit for supplying fuel from a fuel tank to an engine, the fuel supply unit comprising:

a fuel delivery module having a housing defining a reservoir, the fuel delivery module including a fuel pump for pressurizing fuel in the reservoir; and a jet pump assembly having a suction tube defining a suction chamber and a nozzle situated inside the suction chamber, the nozzle receiving pressurized fuel from the fuel pump and spraying fuel from a nozzle tip at high velocity to draw additional fuel into the suction chamber through an inlet formed in the suction tube, the jet pump assembly further comprising a flange projecting laterally from the suction tube, the flange comprising a first snap feature, and the fuel delivery module further comprising a second snap feature formed on the housing of the fuel delivery module, the first and second snap features cooperating to selectively connect the jet pump assembly to the fuel delivery module.

2. The fuel supply unit of claim 1, the jet pump assembly further comprising an inlet tube fluidically connected to the nozzle and to the fuel pump, the inlet tube extending through the suction tube and into the suction chamber.

3. The fuel supply unit of claim 2, wherein the inlet tube and the inlet formed in the suction tube are both positioned vertically below the nozzle tip approximately the same distance.

4. The fuel supply unit of claim 1, wherein the inlet formed in the suction tube is positioned at least 10 mm below the nozzle tip.

5. The fuel supply unit of claim 1, wherein the inlet formed in the suction tube is positioned at least 15 mm below the nozzle tip.

6. The fuel supply unit of claim 1, wherein an upper end of the suction tube presses against the housing of the fuel delivery module to create a seal.

7. The fuel supply unit of claim 6, wherein the entire seal is positioned vertically above the inlet formed in the suction tube.

8. The fuel supply unit of claim 6, wherein the outer surface of the suction tube frictionally engages the housing of the fuel delivery module to form a portion of the seal.

9. The fuel supply unit of claim 1, wherein the fuel delivery module includes an exterior recess sized to receive the jet pump assembly.

10. The fuel supply unit of claim 9, wherein the recess includes a tubular pocket sized to receive an upper end of the suction tube.

11. The fuel supply unit of claim 9, wherein the housing further includes a shield wall proximate the recess to protect the jet pump assembly.

12. The fuel supply unit of claim 1, wherein the jet pump assembly is vertically oriented.

13. The fuel supply unit of claim 1, wherein the inlet formed in the suction tube is formed proximate a bottom surface of the suction tube.

14. The fuel supply unit of claim 13, wherein the suction chamber is downwardly opening to define the inlet of the suction tube.

15. The fuel supply unit of claim 13, wherein a lower end of the suction tube includes a plurality of notches forming a portion of the inlet of the suction tube.

16. An in-tank fuel supply unit for supplying fuel from a fuel tank to an engine, the fuel supply unit comprising:

a fuel delivery module having a housing defining a reservoir, the fuel delivery module including a fuel pump for pressurizing fuel in the reservoir; and a jet pump assembly having a suction tube defining a suction chamber and a nozzle situated inside the suction chamber, the nozzle receiving pressurized fuel from the fuel pump and spraying fuel from a nozzle tip at high velocity to draw additional fuel into the suction chamber through an inlet formed in the suction tube, wherein the suction tube, nozzle, and inlet tube are integrally formed, and wherein the jet pump further comprises an end cap welded at the juncture between the inlet tube and the nozzle, the end cap defining a portion of a flow passageway from the inlet tube to the nozzle;

the jet pump assembly being selectively attachable to the fuel delivery module.

17. The fuel supply unit of claim 16, wherein the jet pump assembly is vertically oriented.

* * * * *